US011786924B2

(12) United States Patent
Sabherwal et al.

(10) Patent No.: US 11,786,924 B2
(45) Date of Patent: Oct. 17, 2023

(54) VARIABLE DOSE CONTAINER

(71) Applicant: GlaxoSmithKline Consumer Healthcare Holdings (US) LLC, Wilmington, DE (US)

(72) Inventors: Amit Sabherwal, Warren, NJ (US); Gregory Ornoski, Warren, NJ (US)

(73) Assignee: GLAXOSMITHKLINE CONSUMER HEALTHCARE HOLDINGS (US) LLC, Wilmington, DE (US)

( * ) Notice: Subject to any disclaimer, the term of this patent is extended or adjusted under 35 U.S.C. 154(b) by 0 days.

(21) Appl. No.: 17/276,876

(22) PCT Filed: Sep. 20, 2019

(86) PCT No.: PCT/US2019/052069
§ 371 (c)(1),
(2) Date: Mar. 17, 2021

(87) PCT Pub. No.: WO2020/061402
PCT Pub. Date: Mar. 26, 2020

(65) Prior Publication Data

US 2022/0032330 A1 Feb. 3, 2022

Related U.S. Application Data

(60) Provisional application No. 62/781,688, filed on Dec. 19, 2018, provisional application No. 62/733,841, filed on Sep. 20, 2018.

(51) Int. Cl.
*B05B 11/00* (2023.01)
*B05B 11/10* (2023.01)

(52) U.S. Cl.
CPC ..... *B05B 11/1008* (2023.01); *B05B 11/1059* (2023.01)

(58) Field of Classification Search
CPC ..... B05B 11/3008; B05B 11/3059; B05B 11/0054; B05B 15/005; B05B 11/1008; B05B 11/1059
(Continued)

(56) References Cited

U.S. PATENT DOCUMENTS 4,871,092 A 10/1989 Maerte
6,116,475 A 9/2000 Delage
(Continued)

FOREIGN PATENT DOCUMENTS

CA 2 317 294 A1 1/2001
CN 106 477 154 A 8/2017
WO WO2016/176165 A1 11/2016

OTHER PUBLICATIONS

Center for Drug Evalulation and Research (Abreva) Jul. 25, 2000. Retrieved from Internet on Nov. 14, 2019. URL: <https://www.accessdata.fda.gov/drugsatfda_docs/nda/2000/20-941_Abreva_prntlbl.pdf>.

*Primary Examiner* — Vishal Pancholi
(74) *Attorney, Agent, or Firm* — Roshni A. Sitapara

(57) ABSTRACT

Aspects of the present invention are directed to a variable dose container. The variable dose container may comprise a container including a top portion, a bottom portion, and a side wall portion, the space between the bottom portion and the side wall portion defining an interior space, wherein the container stores contents within the interior space. The variable dose container may further include an actuator coupled with the top portion of the container that is depressible in a longitudinal direction to drive the contents held in the interior space of the container out of a nozzle protruding horizontally from the actuator. Additionally, the variable dose container may include a collar under the nozzle, a top circumferential edge of the collar containing one or more grooves of varying depth into which the nozzle can be
(Continued)

inserted when depressed, thereby adjusting a distance the actuator is moved in the longitudinal direction.

19 Claims, 9 Drawing Sheets

(58) Field of Classification Search
USPC ..... 222/494
See application file for complete search history.

(56) References Cited

U.S. PATENT DOCUMENTS

| | | | | |
|---|---|---|---|---|
| 6,624,114 | B1 | 9/2003 | Eberle et al. | |
| 6,932,244 | B2 * | 8/2005 | Meshberg | B05B 11/0032 222/153.13 |
| 8,308,029 | B2 * | 11/2012 | Ki | B05B 11/3008 222/309 |
| 9,010,581 | B2 * | 4/2015 | Presche | B05B 11/3052 222/153.13 |
| 9,789,502 | B2 * | 10/2017 | Maddy | B05B 11/3059 |
| 2012/0205402 | A1 | 8/2012 | Chapin | |
| 2013/0026186 | A1 * | 1/2013 | Jenkins | B05B 11/3025 222/153.13 |
| 2014/0203097 | A1 | 7/2014 | Edwards | |

* cited by examiner

VARIABLE DOSE CONTAINER

This application is a 371 of International Application No. PCT/US2019/052069, filed 20 Sep. 2019, which claims the benefit of U.S. 62/781,688, filed 19 Dec. 2018 and U.S. 62/733,841, filed 20 Sep. 2018.

TECHNOLOGY FIELD

Aspects of the present invention are directed to a variable dose container for dispensing the contents of the container and including a collar to allow a user to select the amount of contents to be dispensed.

BACKGROUND

Containers with pumps provide a hygienic and convenient way to dispense contents contained within the container. Such containers are readily used with pharmaceuticals, cosmetics, and the food industry. Typically, a user presses down on an actuator or button, which enables the pump within, and a predetermined amount of contents is dispensed from the nozzle of the actuator.

In a conventional container, the amount of contents that is dispensed is constant every time the user presses down on the actuator because the piston travels the same distance with each pump. It is difficult for a user to manually control the distance that the piston is moved when pressing the actuator. Thus, regardless of the amount of contents that is needed by the user, the same amount is always discharged from the container. A user is not able to select and customize the amount of contents that is dispensed from the container which results in waste and an inconvenience user experience.

Containers that may allow for varied dosing are often bulky and complicated in construction. Additionally, such containers can involve many individual parts and can be expensive to manufacture resulting in an increased end cost for the user.

Based on the concerns noted above, a variable dose container with a simple construction that easily allows a user to select the amount of contents to be dispensed is highly desirable.

SUMMARY

Aspects of the present invention are directed to a variable dose container comprising: a container including a top portion, a bottom portion, and a side wall portion, the space between the bottom portion and the side wall portion defining an interior space, wherein the container stores contents within the interior space; an actuator coupled with the container, wherein the actuator is depressible in a longitudinal direction to drive the contents held in the interior space of the container out of a nozzle protruding horizontally from the actuator; and a collar under the nozzle, the top circumferential edge of the collar containing one or more grooves of varying depth into which the nozzle can be inserted when depressed, thereby adjusting a distance the actuator is moved in the longitudinal direction.

The present invention further provides that the nozzle protrudes from the actuator in a direction perpendicular to the actuator. The present invention further provides that the actuator is rotatable to align the nozzle above the one or more grooves. The present invention further provides that the collar is rotatable to align the nozzle above the one or more grooves.

The present invention further provides that the container includes a shoulder and a hollow circular neck provided on the shoulder. The present invention further provides that the collar is provided on the shoulder. The present invention further provides that a top end of a tube extends into the neck and a bottom end of the tube extends to the contents held in the interior space of the container.

The present invention further provides that the one or more grooves includes a high dose dispensing groove having a depth between about 2.0 mm and about 5.5 mm. The present invention further provides that the high dose dispensing groove has a depth of about 3.1 mm. The present invention further provides that the one or more grooves includes a low dose dispensing groove having a depth between about 0.1 mm and about 3.1 mm. The present invention further provides that the low dose dispensing groove has a depth of about 0.8 mm. The present invention further provides that a high dose is in an amount between about 1 mg and about 7 mg. The present invention further provides that a low dose is in an amount between about 0.5 mg and about 3 mg.

The present invention further provides that the contents stored in the interior space of the container is docosanol. The present invention further provides that the contents stored in the interior space of the container is a combination of docosanol, benzyl alcohol, light mineral oil, propylene glycol, water, sucrose distearate, sucrose stearate.

The present invention further provides for a collar comprising: one or more grooves of varying depth provided on a top circumferential edge of the collar; wherein the collar can be provided around a container, the container including an actuator that is depressible in a longitudinal direction to drive contents held in an interior space of the container out of a nozzle protruding from the actuator in a horizontal direction; wherein the collar is provided under the nozzle; and wherein, the nozzle can be inserted into the one or more grooves when depressed, thereby adjusting a distance the actuator is moved in the longitudinal direction.

The present invention further provides that the collar has a thickness between about 0.5 mm and about 1.5 mm, an inner diameter between about 11.5 mm and about 13 mm, and a height between about 11.5 mm and about 13.5 mm.

FIGURES

DETAILED DESCRIPTION

Aspects of the present invention are directed to a variable dose container having a pump for dispensing a contents of the variable dose container via an actuator including a nozzle, and a collar to allow a user to select the amount of contents to be dispensed. The collar is equipped with grooves of varying depth so that the operating distance to which the actuator is moved to discharge the contents can be adjusted to control the amount of contents that is discharged without changing the functionality of the inner pump. The greater the depth of the groove, the lower the actuator can be depressed by a user resulting in more contents being dispensed from the container. A user can position a groove of a desired depth under the nozzle, thereby when the nozzle is depressed, the groove creates a mechanical stop preventing the nozzle from being depressed further than the intended amount. Thus, a user can select the amount of contents to be dispensed from the container.

Figure 1:
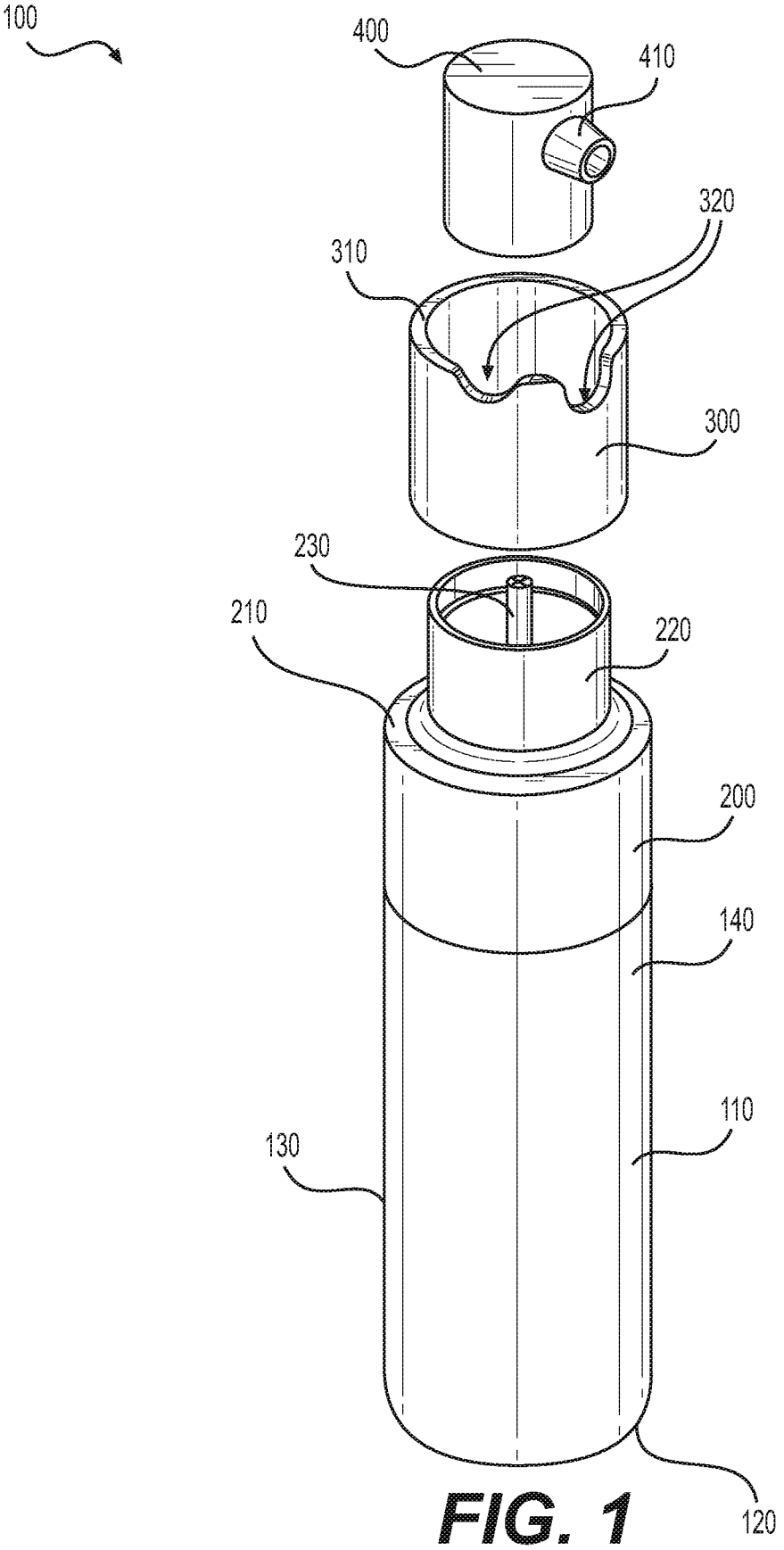
FIG. 1 illustrates an exploded view of a variable dose container of the present invention.

The variable dose container 100 of the present invention is generally depicted in FIG. 1. Specifically, FIG. 1 illustrates an exploded view of the variable dose container 100 according to the present invention. As shown in FIG. 1, the variable dose container 100 includes a container 110, a collar 300, an actuator 400, and a nozzle 410 provided on the actuator 400. The container 110 has a top portion 140, a side wall portion 130, and a bottom portion 120. The side wall portion 130 extends upwards from the bottom portion 120 towards the top portion 140 to define an interior space. The container may store contents within the interior space.

The container 110 further includes a shoulder 210 and a hollow circular neck 220 provided on the shoulder 210. A tube 230 may be provided such that a top end of the tube 230 extends into the neck 220 and a bottom end of the tube 230 extends into the container to the contents held in the interior space.

In an embodiment, the container 110 may consist of two separate pieces wherein a cap portion 200 may be a separate removable piece which may be snap fitted or friction fitted to the top portion 140 to create a permanent and airtight seal. In another embodiment, the cap portion 200 may be formed integrally with the rest of the container 110 so that the container 110 constitutes a single continuous piece.

The collar 300 may be coupled to the outer surface of the neck 220 and extend around the circumference of the neck so that the bottom surface of the collar 300 sits on the top surface of the shoulder 210. The collar 300 comprises one or more grooves 320 of varying depth. In an embodiment, the collar 300 may be a solid piece and attached to the neck 220 during assembly of the variable dose container 100. In another embodiment, the collar 300 may have a vertical slit extending from a top circumferential edge 310 of the collar 300 to a bottom edge. In such an embodiment, the vertical slit can be stretched so that the collar 300 can be snapped onto the variable dose container 100 at any point during or after assembly.

In an embodiment the collar 300 may be a separate piece from the remainder of the container 110. In another embodiment, the collar 300 may be continuous with the container 110 and integrally formed with the container 110 so that the container 110, the cap portion 200, and the collar 300 all constitute one single piece. In another embodiment, the collar 300 may be formed integrally with the cap portion 200 and the cap portion 200 and the collar 300 may be a singular separate piece from the remainder of the container 110.

In an embodiment, the collar 300 may be rotated by a user around the neck 200 in either direction while the remainder of the variable dose container 100 remains stationary in a rotational direction. In another embodiment, the collar 300 may be attached to the neck 220 so as to be fixed in a stationary position.

The actuator 400 is coupled with the container 110 and is depressible in a longitudinal direction. In an embodiment, the actuator 400 may be adapted to fit in the inner hollow portion of the neck 220. In another embodiment, the actuator 400 may be provided so as to be external to the neck 220. The tube 230 extends upwards into the actuator 400 to facilitate the movement of the contents out of the container through the nozzle 410 when the actuator 400 is depressed. In an embodiment, the actuator 400 may be affix to the inner surface of the neck 220. In another embodiment, the actuator 400 may be attached to the top of the tube 230, and a gap may be present between the actuator 400 and the inner surface of the neck 220 extending around the entirety of the actuator 400. In an embodiment, the actuator 400 can be rotated by a user about a longitudinal axis in either direction while the collar 300 and the other components of the variable dose container 100 remain stationary. In another embodiment, the actuator 400 may be stationary in a rotational direction.

The actuator 400 includes the nozzle 410 protruding in a horizontal direction from the actuator 400. The actuator 400 may be depressed in a longitudinal direction by a user to engage the internal pump and drive the movement of the contents out of the container 110 through the nozzle 410. In an embodiment, the nozzle 410 is provided at an angle between about 45° and about 120° relative to the actuator 400. In a preferred embodiment, the nozzle 410 protrudes from the actuator 400 in a direction perpendicular to the actuator 400. The nozzle 410 includes an orifice from which the contents can be discharged.

In an embodiment, the collar 300 may be stationary, and the actuator 400 may be rotated by a user in either direction to move the position of the nozzle 410 to be above a desired groove 320 provided on the collar 300 in order to dispense the desired amount of product from the container 110. In another embodiment, the actuator 400 may be stationary in a rotational direction, and the collar 300 may be rotated by a user in either direction to place the selected groove 320 under the nozzle 410. Thereafter, when the actuator 400 is depressed by a user, the nozzle 410 abuts the bottom surface of a selected groove 320. The contact of the nozzle 410 with the bottom surface of the selected groove 320 creates a mechanical stop preventing the actuator 400 from being depressed further, thereby controlling the distance that the actuator 400 moves and controlling the amount of contents that is dispensed from the nozzle 410.

Figure 2:
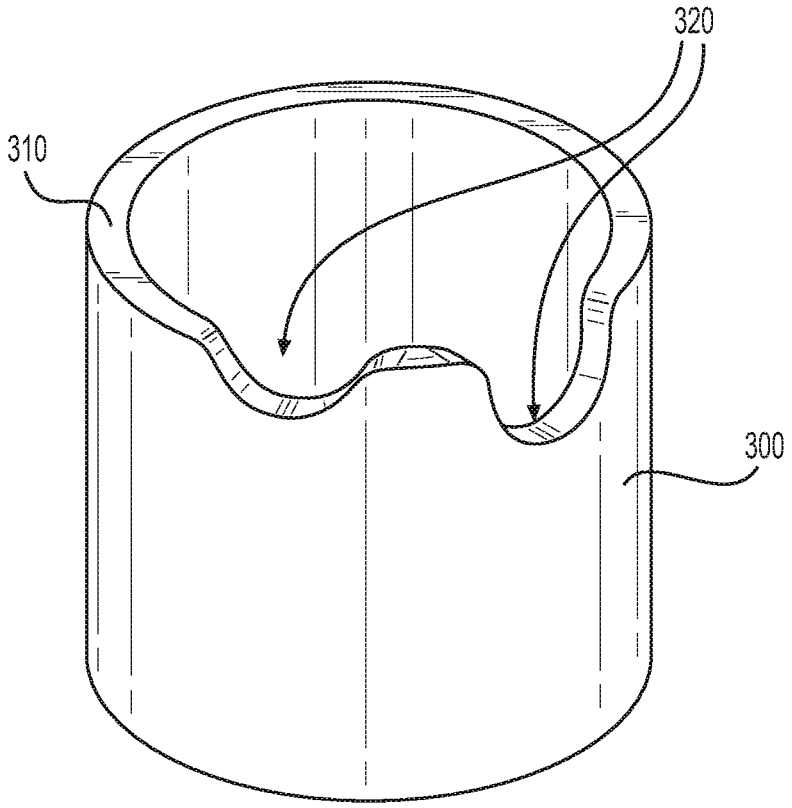
FIG. 2 illustrates a perspective view of a collar of the present invention.

FIG. 2 illustrates a perspective view of the collar 300 according to the present invention. As depicted in FIG. 2, the collar 300 may be a hollow cylindrical shape with one or more grooves 320 of varying depth provided on the top circumferential edge 310 and extending in a downward direction towards the bottom of the collar 300. The shape of the collar 300 is not limited, and the collar 300 can be any suitable shape. The collar 300 has a thickness between about 0.5 mm and about 1.5 mm. In a preferred embodiment, the thickness of the collar 300 is about 1 mm. The inner diameter of the collar 300 is between about 11.5 mm and about 13 mm. In a preferred embodiment, the inner diameter of the collar 300 is about 12.2 mm. The height of the collar 300 is between about 11.5 mm and about 13.5 mm. In a preferred embodiment, the collar has a height of about 12.7 mm.

In an embodiment, the collar may have 1, 3, 4, 5, or 6 grooves into which the nozzle 410 can be inserted when the actuator 400 is depressed. In a preferred embodiment, the collar has 2 grooves. The grooves 320 may have a generally U shape; however, the shape of the grooves 320 is not limited. The grooves 320 may be any suitable shape that can accommodate the curvature of the nozzle 410 and provide a mechanical stop for the longitudinal movement of the actuator 400. In an embodiment, the one or more grooves 320 may allow the actuator to travel between 0% and 100% of the actuator's operating distance. In a preferred embodiment, the one or more grooves 320 of the collar allows the actuator to be depressed to about 0% of the actuator's operating distance, about 25% of the actuator's operating distance, about 50% of the actuator's operating distance, about 75% of the actuator's operating distance, about 100% of actuator's operating distance, or any combination thereof. The grooves 320 may be provided at any point around the collar. In an embodiment, the grooves may be positioned so that a rotation of between about 25° and about 180° will move the position of the nozzle from over one groove 320 to over another groove 320. In a preferred embodiment, a rotation of about 75° will move the position of the nozzle from over one groove 320 to over the other groove 320.

Figure 3:
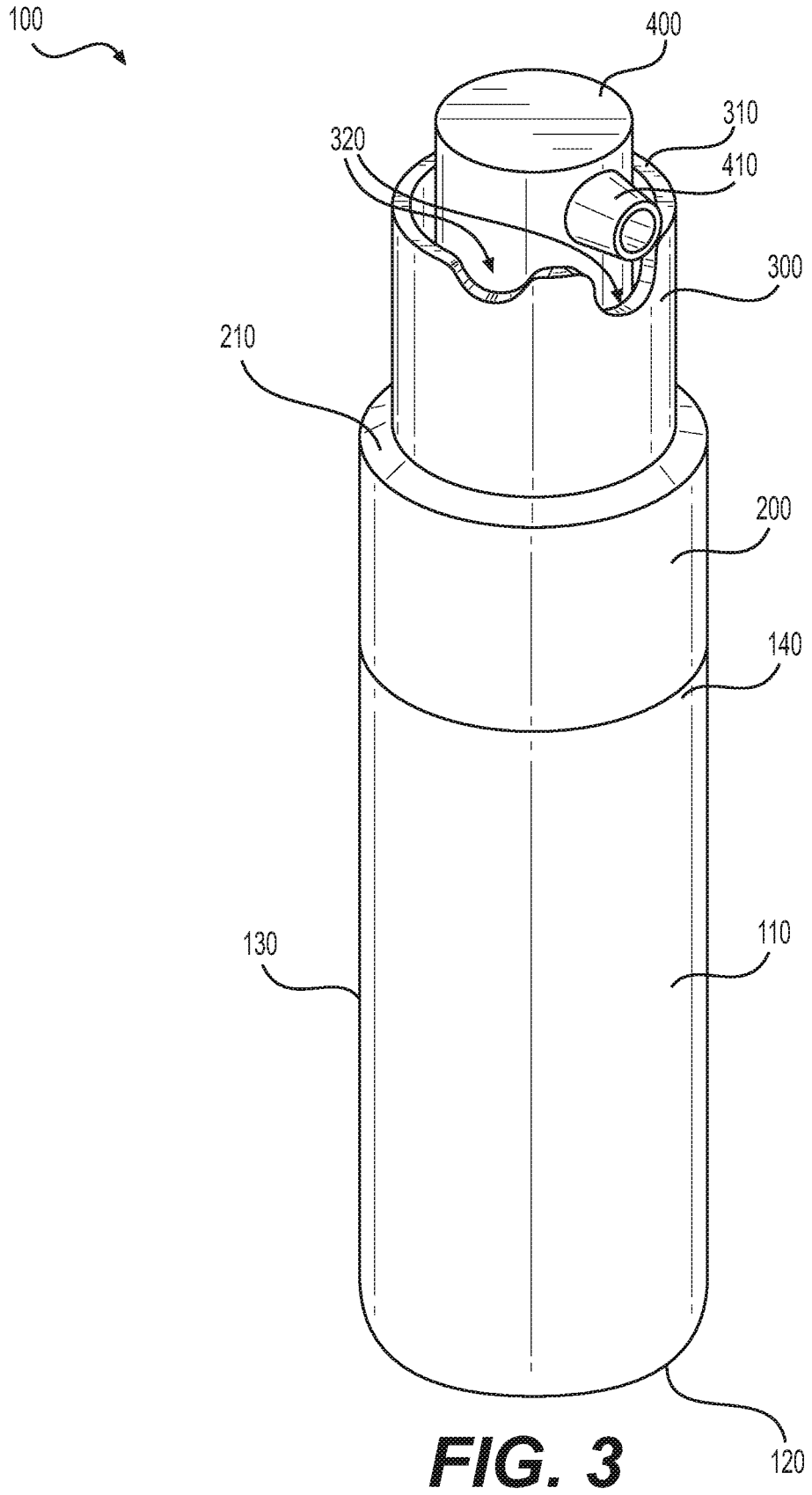
FIG. 3 illustrates a perspective view of the variable dose container of the present invention in a high dose resting state.

FIG. 3 illustrates a perspective view of the variable dose container 100 according to the present invention in a high dose resting state. In a high dose resting state, the nozzle 410 is positioned above a groove 320 which allows a high dose of contents to be dispensed. In an embodiment, a user can rotate the collar 300 so as to position the collar 300 in the high dose resting state. In another embodiment, a user can rotate the actuator 400 in order to position the nozzle in the high dose resting state. In this state, the variable dose container 100 is ready for use and when in use, a high dose of the contents will be dispensed. A high dose may be in an amount between about 1 mg and about 7 mg. In a preferred embodiment, the high dose is equal to about 4 mg.

Figure 4:
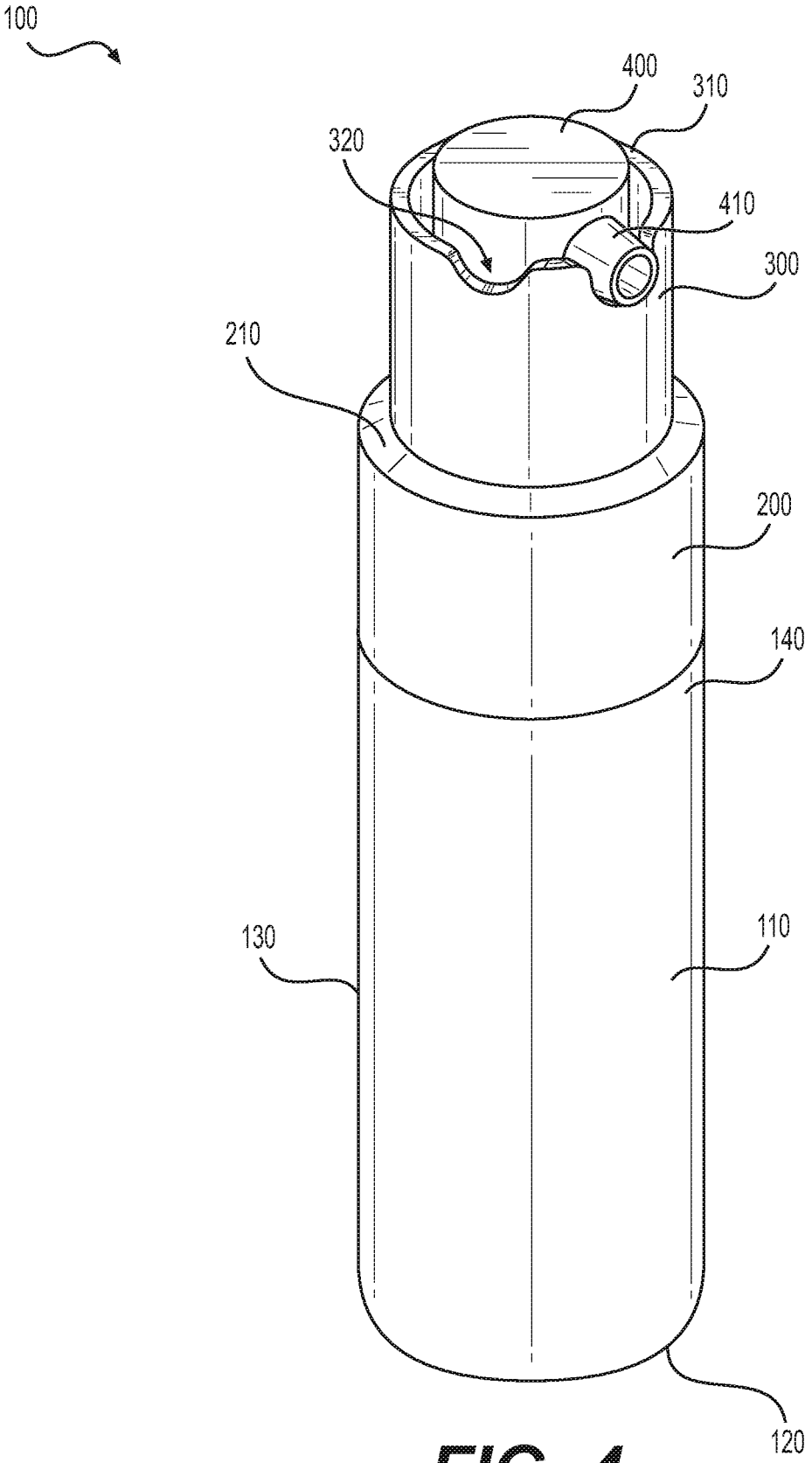
FIG. 4 illustrates a perspective view of the variable dose container of the present invention in a high dose dispensing state.

FIG. 4 illustrates a perspective view of the variable dose container 100 in accordance with the present invention. In particular, the variable dose container 100 in FIG. 4 is in a high dose dispensing state. In this state, the actuator 400 is depressed by a user and contents is discharged from the container 110 through the nozzle 410 in an amount equivalent to a high dose. While being depressed, the nozzle 410 abuts the bottom surface of the corresponding groove 320 so that the actuator 410 can be readily depressed an appropriate amount by a user. The larger the depth of the groove 320, the more product can be dispensed from the container 110. In an embodiment, the groove of the high dose dispensing state may have a depth between about 2.0 mm and about 4.5 mm. In a preferred embodiment, the groove of the high dose dispensing state has a depth of about 3.1 mm.

Figure 5:
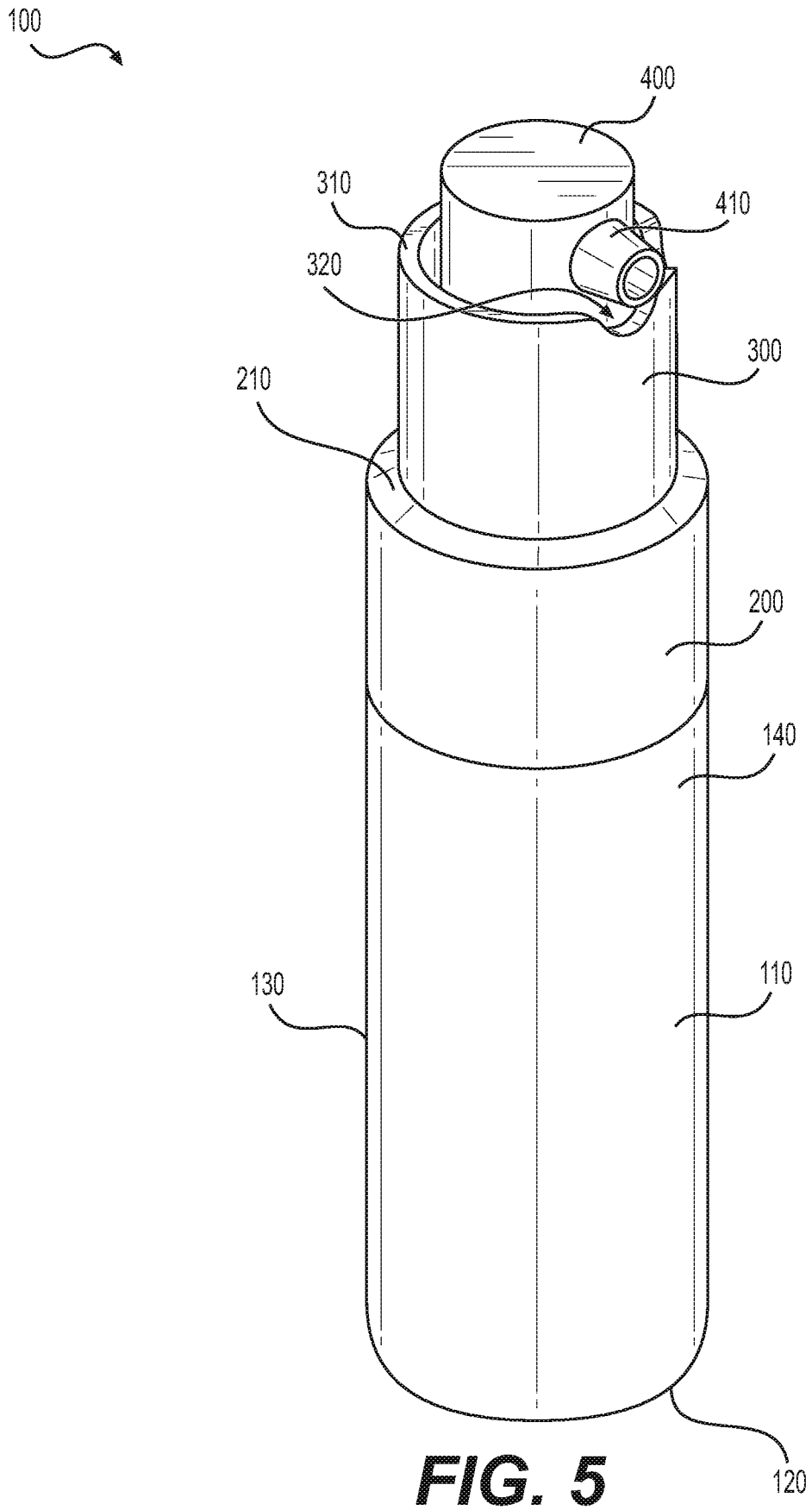
FIG. 5 illustrates a perspective view of the variable dose container of the present invention in a low dose resting state.

FIG. 5 illustrates a perspective view of the variable dose container 100 in accordance with the present invention. FIG. 5 depicts the variable dose container 100 in a low dose resting state. In a low dose resting state, the nozzle 410 of the actuator 400 is positioned above a groove 320 which allows for a low dose of contents to be dispensed. A low dose may be in an amount between about 0.5 mg and about 3 mg. In a preferred embodiment, the low dose is equal to about 2.5 mg.

Figure 6:
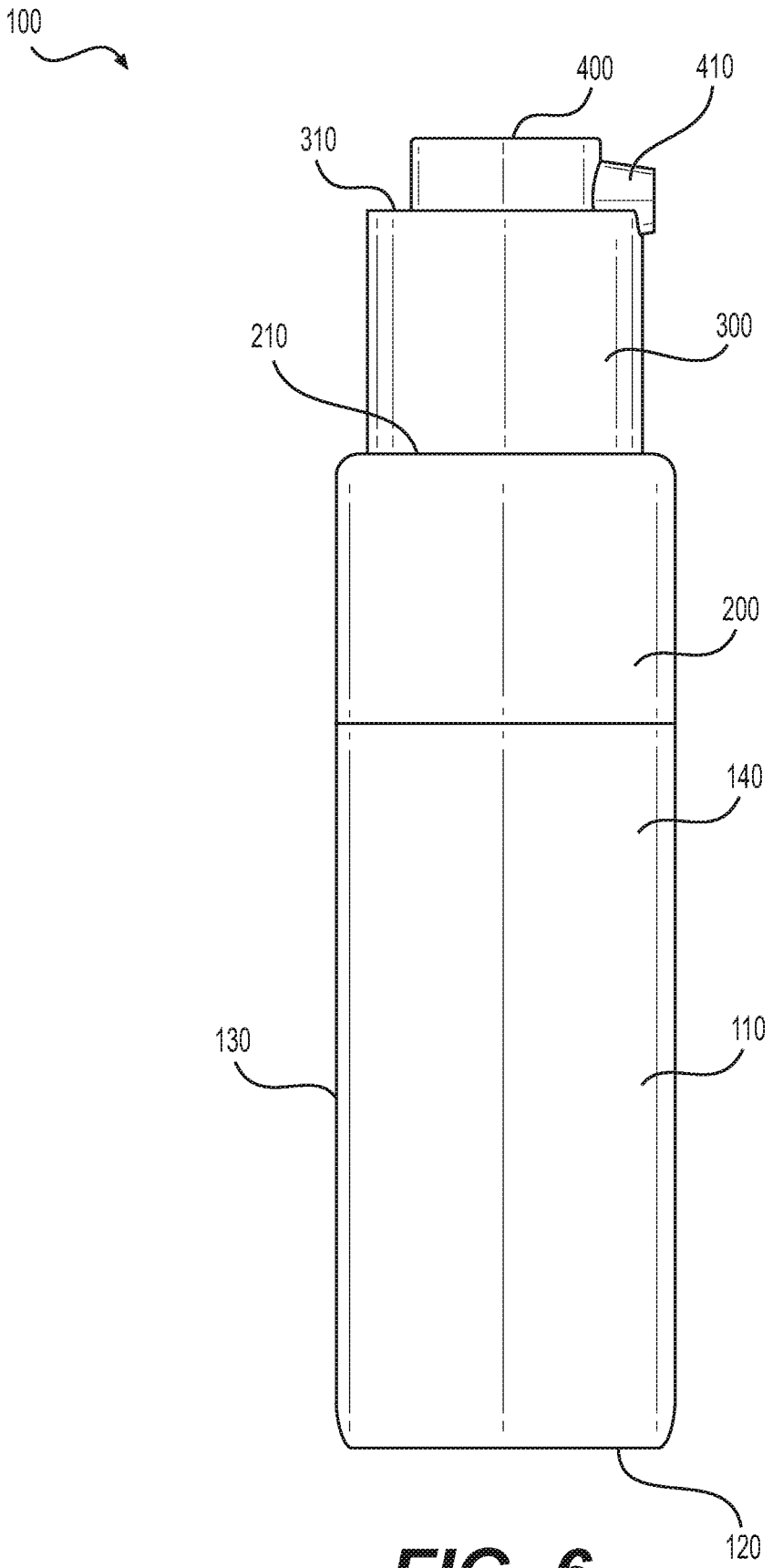
FIG. 6 illustrates a side view of the variable dose container of the present invention in a low dose dispensing state.

FIG. 6 is a side view illustrating the variable dose container 100 in a low dose dispensing state. In this state, the actuator 400 is depressed by a user and product is discharged from the container 110 in an amount equivalent to a low dose. While being depressed, the nozzle 410 of the actuator 400 abuts the bottom surface of the corresponding groove 320 and the actuator 400 is prevented from being depressed fully; thus, dispensing a lower dose of contents as compared to the high dose dispensing state.

As can be seen in FIG. 6, when the actuator 400 is depressed, the nozzle 410 extends beyond the top circumferential edge 310 of the collar 300. Thus, the contents may be readily dispensed from the nozzle 410 directly onto a user's finger for easy application resulting in a convenient user experience. Furthermore, the dispensed contents do not come into contact with the collar 300 or any other outer part of the variable dose container 100 in order to avoid contamination and waste of the contents.

Figure 7:
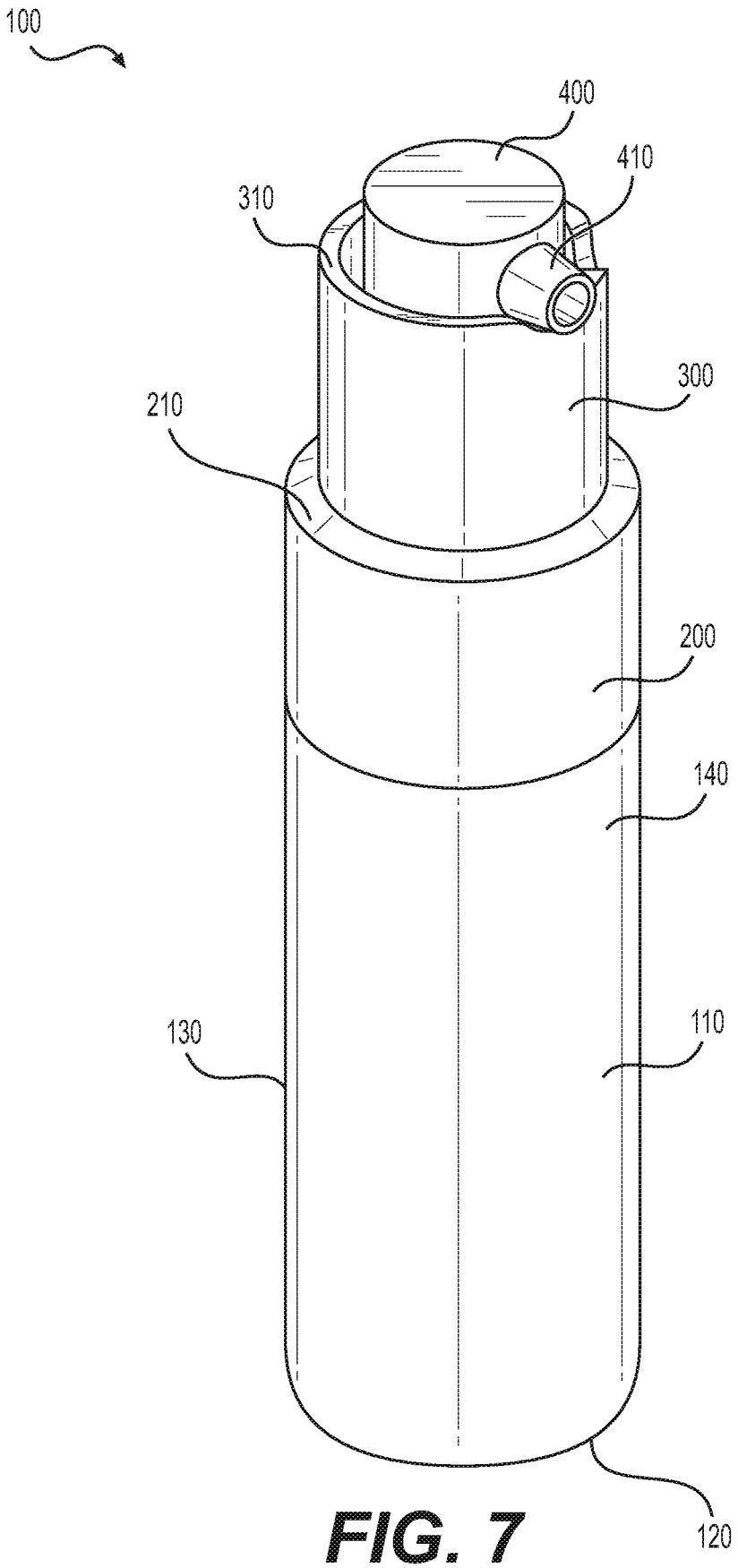
FIG. 7 illustrates a perspective view of the variable dose container of the present invention in the low dose dispensing state.

FIG. 7 is a perspective view of the variable dose container 100 according to the present invention in a low dose dispensing state. In an embodiment, the groove of the low dose dispensing state may have a depth between about 0.1 mm to about 3.1 mm. In a preferred embodiment, the groove of the low dose dispensing state has a depth of about 0.8 mm.

Figure 8:
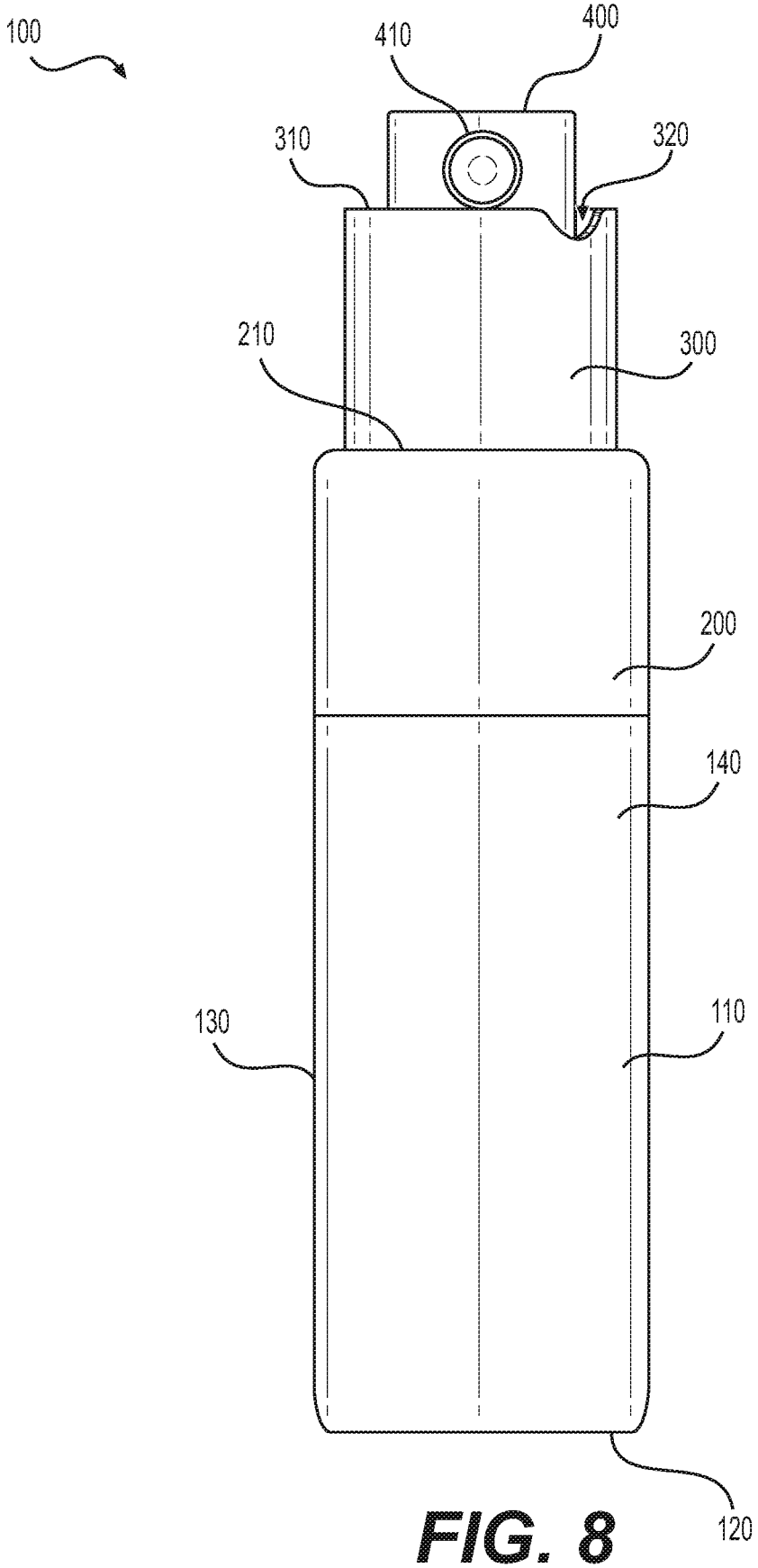
FIG. 8 illustrates a front view of the variable dose container of the present invention in a locked state.

FIG. 8 is a front view illustrating the variable dose container 100 according to the present invention in a locked state. When the variable dose container 100 is not in use, it may be locked to avoid accidentally discharging any contents. In a locked state, the nozzle 410 may be positioned so as to extend over a top circumferential edge 310 of the collar 300. In this position, the nozzle 410 abuts the top circumferential edge 310 and the actuator 400 cannot be depressed. All vertical movement of the actuator 400 is mechanically stopped by the top circumferential edge 310 when the variable dose container 100 is in the locked state. In an embodiment, a user can rotate the actuator 400 so that the nozzle 410 may be positioned over the top circumferential edge 310 of the collar 300 at any point not having a groove 320 in order to position the variable dose container in a locked state. In another embodiment, the variable dose container 100 can be placed in the locked state by rotating the collar 300 so that a portion of a top circumferential edge 310 of the collar 300 not having a groove 320 is positioned under the nozzle 410.

Figure 9:
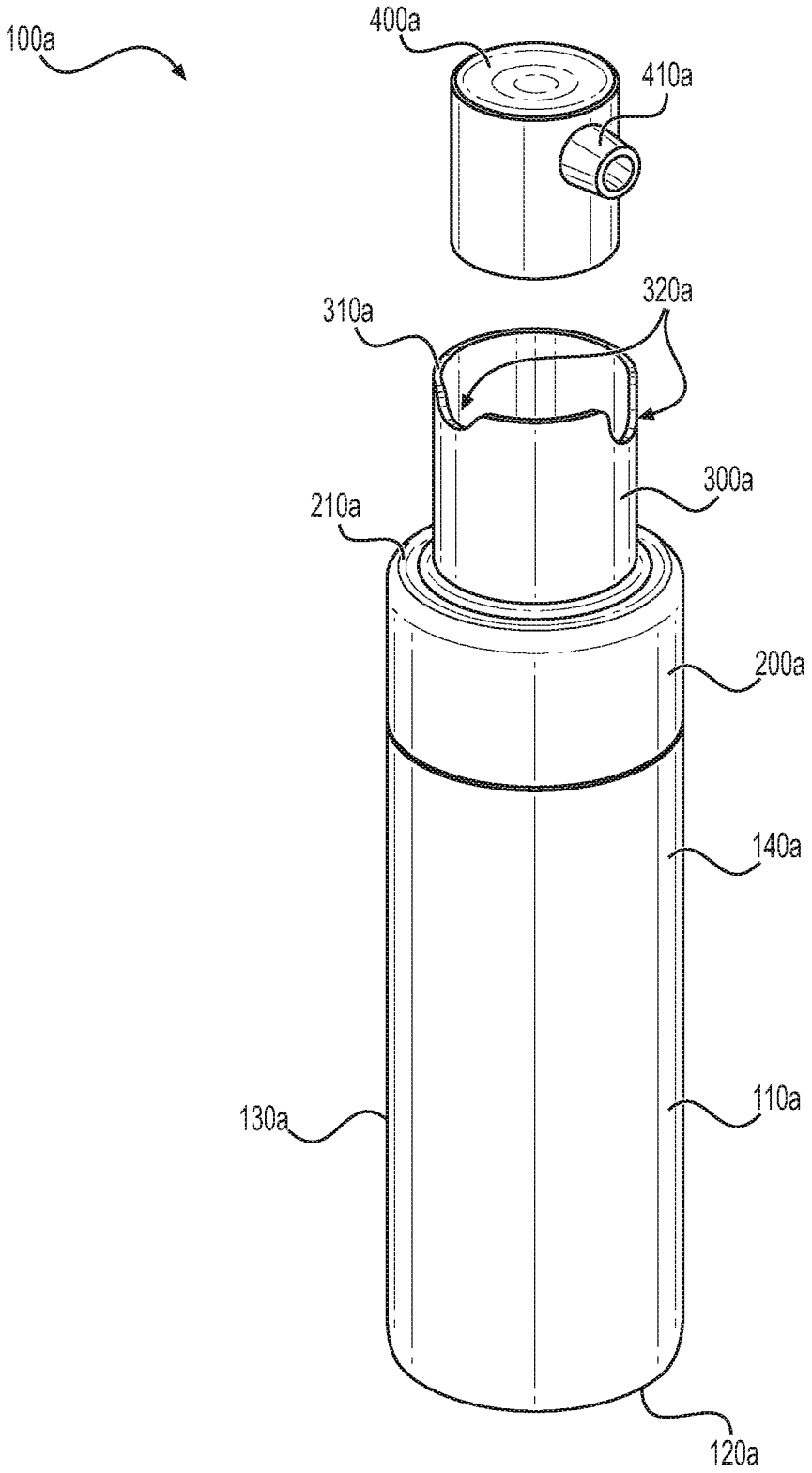
FIG. 9 illustrates an exploded view of a variable dose container according to a second embodiment of the present invention.

FIG. 9 illustrates an exploded view of a variable dose container according to a second embodiment of the present invention. As shown in FIG. 9, the variable dose container **100*a* according to a second embodiment includes a container 110*a* having a collar portion 300*a*, an actuator 400*a*, and a nozzle 410*a* provided on the actuator 400*a*. The container 110*a* further includes a top portion 140*a*, a side wall portion 130*a*, a bottom portion 120*a*, and a shoulder 210*a*. The side wall portion 130*a* extends upwards from the bottom portion 120*a* towards the top portion 140*a* to define an interior space of the container 110*a*. The container 110*a* may store contents within the interior space. The collar portion 300*a* is provided on the shoulder 210*a* of the container 110*a*. A tube may be provided such that a top end of the tube extends into the collar portion 300*a* and a bottom end of the tube extends down into the container 110*a*** to the contents held in the interior space.

In this embodiment, the container **110*a* may consist of two separate pieces wherein a cap portion 200*a* may be a separate removable piece which may be snap fitted or friction fitted to the top portion 140*a* to create a permanent and airtight seal. In another embodiment, the cap portion 200*a* may be formed integrally with the rest of the container 110*a* so that the container 110*a*** constitutes a single continuous piece.

The bottom of the collar portion 300*a* of the container 110*a* is provided on the top surface of the shoulder 210*a*. The collar portion 300*a* comprises one or more grooves 320*a* of varying depth. In a preferred embodiment, the collar portion 300*a* may be formed integrally with the cap portion 200*a* and the cap portion 200*a* and the collar portion 300*a* may be a singular separate piece from the remainder of the container 110*a*. In another embodiment, the collar portion 300*a* may be continuous with the container 110*a* and integrally formed with the container 110*a* so that the container 110*a*, the collar portion 300*a*, and the cap 200*a* all constitute one single piece. In another embodiment the collar portion 300*a* may be a separate piece from the remainder of the container 110*a*. In such an embodiment, the collar portion 300*a* may be attached to the shoulder 210*a* during assembly of the integrated variable dose container 100*a*.

The actuator 400*a* is coupled with the container 110*a* and is depressible in a longitudinal direction. In a preferred embodiment, the actuator 400*a* may be adapted to fit in the inner hollow portion of the collar portion 300*a*. In another embodiment, the actuator 400*a* may be provided so as to be external to the collar portion 300*a*. A tube extends upwards into the actuator 400*a* to facilitate the movement of the contents out of the container through the nozzle 410*a* when the actuator 400*a* is depressed. In an embodiment, the actuator 400*a* may be affix to the inner surface of the collar portion 300*a*. In another embodiment, the actuator 400*a* may be attached to the top of the tube, and a gap may be present between the actuator 400*a* and the inner surface of the collar portion 300*a* extending around the entirety of the actuator 400*a*. In a preferred embodiment, the actuator 400*a* can be rotated by a user about a longitudinal axis in either direction while the collar portion 300*a* and the other components of the integrated variable dose container 100*a* remain stationary.

The actuator 400*a* includes the nozzle 410*a* protruding in a horizontal direction from the actuator 400*a*. The actuator 400*a* may be depressed in a longitudinal direction by a user to engage the internal pump and drive the movement of the contents out of the container 110*a* through the nozzle 410*a*. In an embodiment, the nozzle 410*a* is provided at an angle between about 45° and about 120° relative to the actuator 400*a*. In a preferred embodiment, the nozzle 410*a* protrudes from the actuator 400*a* in a direction perpendicular to the actuator 400*a*. The nozzle 410*a* includes an orifice from which the contents can be discharged.

In a preferred embodiment, the collar portion 300*a* may be stationary, and the actuator 400*a* may be rotated by a user in either direction to move the position of the nozzle 410*a* to be above a desired groove 320*a* provided on the collar portion 300*a* in order to dispense the desired amount of product from the container 110*a*. When the actuator 400*a* is depressed by a user, the nozzle 410*a* abuts the bottom surface of a selected groove 320*a* which creates a mechanical stop preventing the actuator 400*a* from being depressed further.

The contents provided within the interior space of the container may be any compound or composition that can be used to treat and/or prevent cold sores/fever blisters, cleanse the skin, provide pain relief, or provide overall health and wellness benefits to the user. Non-limiting examples of the contents may include pharmaceutical active ingredients including over the counter actives, behind the counter actives, prescription actives, and any combination thereof.

In an embodiment, the contents may be docosanol. In another embodiment, the contents may include a combination of docosanol, benzyl alcohol, light mineral oil, propylene glycol, purified water, sucrose distearate, and sucrose stearate.

In another embodiment, the contents may be acyclovir. In another embodiment, the contents may be a combination of acyclovir and polyethylene glycol. In another embodiment, the contents may be a combination of acyclovir, cetostearyl alcohol, mineral oil, poloxamer 407, propylene glycol, sodium lauryl sulfate, water and white petrolatum. In another embodiment, the contents may be a combination of acyclovir, hydrocortisone, liquid paraffin, white soft paraffin, isopropyl myristate, sodium lauryl sulfate, cetostearyl alcohol, poloxamer 188, propylene glycol, citric acid monohydrate, sodium hydroxide, sodium hydroxide or hydrochloric acid, and purified water. In another embodiment, the contents may be a combination of acyclovir, propylene glycol, white soft paraffin, cetostearyl alcohol, liquid paraffin, arlacel 165, poloxamer 407, dimeticone 20, sodium laurilsulfate, and purified water.

In another embodiment, the contents may be diclofenac. In another embodiment, the contents may be a combination of diclofenac, butylhydroxytoluene, carbomers, cocoyl caprylocaprate, diethylamine, isopropyl alcohol, liquid paraffin, macrogol, cetostostearyl ether, oleyl alcohol, propylene glycol, perfume *eucalyptus* sting, and water. In another embodiment, the contents can include a combination of aqua, caprylic/capric triglyceride, butyrospermum, parki butter, glycerin, xylitol, 1, 2-hexanediol, pentylene glycol, panthenol, behenic acid, hydrogenated lecithin acetamide MEA, palmitamide MEA, polyacrylate crosspoymer-6, caprylhydroxamic acid, acrylates/C10-30 alkyl acrylate crosspolymer, *Oryza sativa*, cera, squalane, sodium hydroxide, t-butyl alcohol, and ceramide 3.

In another embodiment, the contents may include penciclovir. In another embodiment, the contents may include benzalkonium chloride. In another embodiment, the contents may include lysine. In another embodiment, the contents may include pramoxine HCl. In another embodiment, the contents may include benzocaine. In another embodiment, the contents may include lidocaine. In another embodiment, the contents may include menthol. In another embodiment, the contents may include camphor. In another embodiment, the contents may include dimethicone. In another embodiment, the contents may include zinc oxide. In another embodiment, the contents may include petrolatum.

The variable dose container 100 may further include a cap to protect the nozzle from contamination when not in use. In an embodiment, the cap may be a separate removable piece that can be fitted on top of the actuator 400. In another embodiment, the cap may be a flip cap attached to a portion of the variable dose container 100 and capable of being flipped close over the actuator 400 when not in use and flipped open by a user when in use.

The variable dose container 100 of the present invention may be compatible with any pump or spray device, including, but not limited to airless pumps. In an airless pump of the present invention, depressing the actuator 400 creates a vacuum inside of the pump. Thus, when an internal valve opens, the contents flow into the pump and out of the nozzle. As the contents is dispensed, air enters the bottom of the variable dose container 100 and helps advance a piston upwards to offset the vacuum.

The collar 300 of the present invention may be made from any suitable material. Non-limiting examples for suitable materials for the collar include, but are not limited to, aluminum, brass, chrome, polyethylene, and polypropylene, or any combination thereof. In an embodiment the collar 300 is made from a combination of polyethylene, and polypropylene.

What is claimed is:

1. A variable dose container comprising:

a container including a top portion, a bottom portion, and a side wall portion, a space between the bottom portion and the side wall portion defining an interior space, wherein the container stores contents within the interior space;

an actuator coupled with the container, wherein the actuator is depressible in a longitudinal direction to drive the contents held in the interior space of the container out of a nozzle protruding horizontally from the actuator; and a collar under the nozzle, a top circumferential edge of the collar containing one or more grooves of varying depth into which the nozzle can be inserted when depressed, wherein a bottom of the groove creates a mechanical stop thereby adjusting a distance the actuator is moved in the longitudinal direction, wherein the top circumferential edge is the same height around the entirety of the collar, and wherein the container includes a shoulder and a hollow circular neck provided on the shoulder, and wherein the collar is coupled to an outer surface of the neck and extends around the circumference of the neck so that a bottom surface of the collar sits on a top surface of the shoulder.

2. The variable dose container according to claim 1, wherein the nozzle protrudes from the actuator in a direction perpendicular to the actuator.

3. The variable dose container according to claim 1, wherein the actuator is rotatable to align the nozzle above the one or more grooves.

4. The variable dose container according to claim 1, wherein the collar is rotatable to align the nozzle above the one or more grooves.

5. The variable dose container according to claim 1, wherein a top end of a tube extends into the neck and a bottom end of the tube extends to the contents held in the interior space of the container.

6. The variable dose container according to claim 1, wherein the one or more grooves includes a high dose dispensing groove having a depth between about 2.0 mm and about 5.5 mm.

7. The variable dose container according to claim 6, wherein the high dose dispensing groove has a depth of about 3.1 mm.

8. The variable dose container according to claim 1, wherein the one or more grooves includes a low dose dispensing groove having a depth between about 0.1 mm and about 3.1 mm.

9. The variable dose container according to claim 8, wherein the low dose dispensing groove has a depth of about 0.8 mm.

10. The variable dose container according to claim 6, wherein a high dose is in an amount between about 1 mg and about 7 mg.

11. The variable dose container according to claim 8, wherein a low dose is in an amount between about 0.5 mg and about 3 mg.

12. The variable dose container according to claim 1, wherein the contents stored in the interior space of the container is docosanol.

13. The variable dose container according to claim 1, wherein the contents stored in the interior space of the container is a combination of docosanol, benzyl alcohol, light mineral oil, propylene glycol, water, sucrose distearate, sucrose stearate.

14. A collar comprising:

one or more grooves of varying depth provided on a top circumferential edge of the collar;

wherein the top circumferential edge is the same height around the entirety of the collar;

wherein the collar can be provided around a container, the container including an actuator that is depressible in a longitudinal direction to drive contents held in an interior space of the container out of a nozzle protruding from the actuator in a horizontal direction;

wherein the collar is provided under the nozzle; and wherein, the nozzle can be inserted into the one or more grooves when depressed, wherein a bottom of the groove creates a mechanical stop thereby adjusting a distance the actuator is moved in the longitudinal direction.

15. The collar according to claim 14, wherein the one or more grooves includes a high dose dispensing groove having a depth between about 2.0 mm and about 4.5 mm.

16. The collar according to claim 15, wherein the high dose dispensing groove has a depth of about 3.1 mm.

17. The collar according to claim 14, wherein the one or more grooves includes a low dose dispensing groove having a depth between about 0.1 mm and about 3.1 mm.

18. The collar according to claim 17, wherein the low dose dispensing groove has a depth of about 0.8 mm.

19. The collar according to claim 14, wherein the collar has a thickness between about 0.5 mm and about 1.5 mm, an inner diameter between about 11.5 mm and about 13 mm, and a height between about 11.5 mm and about 13.5 mm.

* * * * *